US005403228A

United States Patent [19]

Pasch

[11] Patent Number: 5,403,228

[45] Date of Patent: Apr. 4, 1995

[54] TECHNIQUES FOR ASSEMBLING POLISHING PADS FOR SILICON WAFER POLISHING

[75] Inventor: Nicholas F. Pasch, Pacifica, Calif.

[73] Assignee: LSI Logic Corporation, Milpitas, Calif.

[21] Appl. No.: 88,912

[22] Filed: Jul. 8, 1993

Related U.S. Application Data

[63] Continuation of Ser. No. 911,828, Jul. 10, 1992, abandoned.

[51] Int. Cl.[6] ..... B24B 29/02; B24B 7/22

[52] U.S. Cl. ..... 451/259; 451/921; 451/533; 451/530

[58] Field of Search ..... 51/DIG. 34, 109, 358, 51/394, 401, 406, 398, 131.1, 134; 451/921, 259, 490, 526, 533, 538, 530, 285, 292

[56] References Cited

U.S. PATENT DOCUMENTS

| | | | |
|---|---|---|---|
| 2,958,166 | 11/1960 | Foland | 51/358 |
| 3,149,443 | 9/1964 | Bergmann | 51/382 |
| 3,355,840 | 12/1967 | Bonning | 51/363 |
| 3,504,457 | 4/1970 | Jacobsen | 51/401 |
| 3,844,072 | 9/1974 | Haigh | 51/401 |
| 3,863,395 | 2/1975 | Brown | 51/401 |
| 3,866,361 | 2/1975 | Mauck | 51/358 |
| 4,541,207 | 9/1985 | Antonson | 51/376 |
| 4,607,464 | 8/1986 | Schwartz | 51/362 |
| 4,671,851 | 6/1987 | Reyer | 156/645 |
| 4,674,237 | 6/1987 | Sullivan | 51/401 |
| 4,826,563 | 5/1989 | Hassett | 156/636 |
| 4,879,258 | 11/1989 | Fisher | 437/225 |
| 4,910,155 | 3/1990 | Cole | 437/8 |
| 4,940,507 | 7/1990 | Harbarger | 156/636 |
| 4,944,836 | 7/1990 | Beyer | 156/645 |
| 4,965,905 | 10/1990 | Kitahata | 15/97 |
| 5,000,761 | 3/1991 | Mayton | 51/295 |
| 5,078,754 | 1/1992 | Jefferies | 51/298 |
| 5,094,972 | 3/1992 | Pierce | 437/67 |
| 5,257,478 | 11/1993 | Hyde et al. | 51/283 R |

FOREIGN PATENT DOCUMENTS

| | | | |
|---|---|---|---|
| 141285 | 4/1980 | Germany | 51/131.3 |
| 0068360 | 3/1988 | Japan | 51/131.4 |

OTHER PUBLICATIONS

Westech's Training Manual "Pad Replacement and Conditioning", dated Oct. 10, 1991 pp. 13 & 14.

*Primary Examiner*—Robert A. Rose

*Attorney, Agent, or Firm*—Hickman & Beyer

[57] ABSTRACT

A technique for mounting polishing pads to a platen in chemi-mechanical polishing apparatus is disclosed. With two polishing pads, prior to assembly, a seal of material impervious to the chemical action of a polishing slurry is disposed about the perimeter of the interface between the pads. Preferably, the seal is a bead of silicon-based "gasket" material, such as General Electric silicon caulk (RTV) or Dow Corning silicon adhesive, and is disposed in a ring at a radius r' about one inch inward from the perimeter (circumference) of the pads. When the pads are assembled together, the bead squashes and (1) forms a seal, and (2) causes the periphery of the upper pad to curve upward—thereby creating a bowl-like reservoir for increasing the residence time of slurry on the face of the pad prior to overflowing the pad.

16 Claims, 3 Drawing Sheets

TECHNIQUES FOR ASSEMBLING POLISHING PADS FOR SILICON WAFER POLISHING

CROSS-REFERENCE TO RELATED APPLICATIONS

This is a continuation of commonly-owned, U.S. patent application Ser. No. 07/911,828, filed Jul. 10, 1992, by Pasch now abandoned.

TECHNICAL FIELD OF THE INVENTION

The present invention relates to techniques for polishing semiconductor devices, more particularly to techniques of chemical-mechanical ("chemi-mechanical" or "chem-mech") polishing wafers.

BACKGROUND OF THE INVENTION

Chemi-mechanical polishing of semiconductor wafers is useful, at various stages of device fabrication, for planarizing irregular top surface topography, inter alia. For example, in the process of fabricating modern semiconductor integrated circuits, it is necessary to form conductive lines or other structures above previously formed structures. However, prior structure formation often leaves the top surface topography of the silicon wafer highly irregular, with bumps, areas of unequal elevation, troughs, trenches and/or other surface irregularities. As a result of these irregularities, deposition of subsequent layers of materials could easily result in incomplete coverage, breaks in the deposited material, voids, etc., if it were deposited directly over the aforementioned highly irregular surfaces. If the irregularities are not alleviated at each major processing step, the top surface topography of the surface irregularities will tend to become even more irregular, causing further problems as layers stack up in further processing of the semiconductor structure.

Depending upon the type of materials used and their intended purposes, numerous undesirable characteristics are produced when these deposition irregularities occur. Incomplete coverage of an insulating oxide layer can lead to short circuits between metallization layers. Voids can trap air or processing gases, either contaminating further processing steps or simply lowering overall device reliability. Sharp points on conductors can result in unusual, undesirable field effects. In general, processing high density circuits over highly irregular structures can lead to very poor yield and/or device performance.

Consequently, it is desirable to effect some type of planarization, or flattening, of integrated circuit structures in order to facilitate the processing of multi-layer integrated circuits and to improve their yield, performance, and reliability. In fact, all of today's high-density integrated circuit fabrication techniques make use of some method of forming planarized structures at critical points in the fabrication process.

Planarization techniques generally fall into one of several categories: chemical/mechanical polishing techniques; leveling with a filler material then etching back in a controlled environment; and various reflow techniques. Etching techniques can include wet etching, dry or plasma etching, electro-polishing, and ion milling, among others. A few less common planarization techniques exist, such as direct deposition of material into a trench by condensing material from a gaseous phase in the presence of laser light. Most of the differences between modern planarization techniques exist in the points in processing that the different techniques are applied, and in which methods and materials are used.

The present invention is directed to chemi-mechanical polishing, which generally involves rubbing a wafer with a polishing pad in a slurry containing both an abrasive and chemicals. Typical slurry chemistry is KOH (Potassium Hydroxide), having a pH of about 11. Generally, polishing slurry is expensive, and cannot be recovered or reused. Typical usage (feed) rates for slurry are on the order of 175 ml (milli-liters) per minute. A typical silica-based slurry is "SC-1" available from Cabot Industries. Another, more expensive slurry based on silica and cerium (oxide) is Rodel "WS-2000".

Chemi-mechanical polishing is described in U.S. Pat. Nos. 4,671,851, 4,910,155, 4,944,836, all of which patents are incorporated by reference herein. When chemi-mechanical polishing is referred to hereinafter, it should be understood to be performed with a suitable slurry, such as Cabot SC-1.

The current state of the art in dielectric film polishing for silicon wafers suggests the use of more than one polishing pad. For example, two pads are secured into a "stack" which may be termed a "composite polishing pad". The top pad, which performs polishing, is typically stiffer than the more compliant bottom pad, which is mounted to a rotating platen. A pressure sensitive adhesive is typically used to adhere the pads together and to the platen.

FIG. 1 shows a typical technique for chemi-mechanical polishing. A first disc-shaped pad 102 (PAD A) having a layer of pressure sensitive adhesive 104 on its back face is adhered (shown exploded) to the front face of a rotating platen 106 (PLATEN). A second disc-shaped pad 108 (PAD B) having a layer of pressure sensitive adhesive 110 on its back face is adhered (shown exploded) to the front face of the first pad 102. The platen 106 is rotated, and a metered stream of slurry 112 (shown as dots) from a slurry supply 114 is delivered via a slurry feed 116 to the front face of PAD B.

Evidently, centrifugal forces and gravity will cause the slurry to flow (wash) over the periphery of PAD A. This is especially evident since the front face of PAD B is intended to be planar. This washover reduces the "residence time" of slurry on the face of PAD B.

A silicon wafer 120 is lightly pressed (flat) against the front surface of PAD B so that formations (on the pad-confronting face of the wafer) sought to be polished are acted upon by the action of PAD B and the slurry. Typically, the pads 102 and 108 and the platen 106 are on the order of 20–30 inches in diameter, the wafer is 4–6 inches in diameter, and polishing is performed in the center $\frac{2}{3}$ (two-thirds) portion (area) of PAD B.

As the slurry is used, it exits the front surface of PAD B and, as noted above, is not recovered. Evidently, the slurry must be fed onto PAD B at the rate that it exits PAD B, and preferably the rate would be optimized so that the slurry is entirely used, with no loss of un-depleted (un-consumed) slurry. However, this is generally not the case, and the slurry feed rate is established to be higher than would be necessary to deplete the slurry. The slurry is illustrated in FIG. 1 as a single layer of dots, indicating that it is difficult to retain slurry on the front face of PAD B.

Typical pad materials are: (1) for PAD A, foamed polyurethane; and (2) for PAD B, polyester felt stiffened with polyurethane resin. The adhesive backings 104 and 110 for the pads are typically polyurethane based. Generally, it is preferable that PAD B is stiffer than PAD A. In the case that both pads are doped with polyurethane resin, this can be achieved simply by doping PAD B with more polyurethane than PAD A.

Two failure modes are of particular interest. In one mode, the chemicals from the slurry are gradually "wicked" into the pads and gradually attack the adhesive, and adhesive failure can be expected in about three days, which is generally acceptable. This is illustrated at 122, where slurry is shown permeating PAD B and attacking adhesive 110. In another, catastrophic mode, the slurry attacks the adhesive bond between PAD A and PAD B directly, edgewise at the adhesive boundary between the pads, and failure may occur within one half hour, which is very unacceptable. This is illustrated at 124, where slurry is shown attacking the adhesive 110 edgewise between the pads. Eventually, and usually abruptly, the pads will delaminate (come unglued) from one another, which will require stopping the polishing process, and re-setting up the polishing equipment. This is not desirable.

It is known to provide a plastic ring (dam) around the pads, extending upward above the front face of PAD B, primarily for the purpose of creating a reservoir of slurry on the front face of PAD B, which will allow the slurry to be retained longer on the face of PAD B. This is one approach to increasing "residence time" and optimizing the chemical depletion of the slurry before it overflows the ring. However, using a plastic ring required additional setup, and is of little effect with regard to the adhesive failure modes discussed above.

DISCLOSURE OF THE INVENTION

It is an object of the present invention to provide improved techniques for chemi-mechanical polishing.

It is another object of the present invention to provide a technique for reducing catastrophic delamination failures between two pads of a polishing apparatus.

It is another object of the present invention to provide a technique for reducing the amount of slurry used in polishing.

According to the invention, two polishing pads of radius r are assembled to a rotating platen. Prior to assembly, seal of material impervious to the chemical action of polishing slurry is disposed about the perimeter of the interface between the pads. Preferably, the seal is a bead of silicon-based "gasket" material, such as General Electric silicon caulk (RTV) or Dow Corning silicon adhesive, and is disposed in a ring at a radius r' about one inch inward from the perimeter (circumference) of the pads.

The bead of silicon-based gasket material is preferably applied a few thousandths of an inch thick (e.g., 0.002–0.003 inch) and with a width (radial extent) of about one tenth inch. When the pads are assembled together, the bead will "squish" to a width of about one half to one inch. (This accounts for why the bead is applied about one inch within the perimeter of the pads.) Preferably, the bead would cure quickly, i.e. on the order of one half hour. Using bead materials that take hours to cure, it is recommended to perform the setup (assembly) of the pads the evening before the polishing apparatus will be used.

One result of the bead is to form a barrier preventing catastrophic delamination of the pads (i.e., from the pad adhesive being attacked by the slurry).

Another result of the bead is that it will cause the periphery of PAD B to curve upward, forming a bowl-like surface which will retain slurry better than a planar surface. According to an aspect of the invention, the bead dimensions can be adjusted to establish an optimum bowl shape for the front surface of PAD B, thereby optimizing slurry depletion (consumption) and minimizing slurry loss.

In another embodiment of the invention, an integral composite pad is formed, wherein the front face of the upper pad has an annular lip extending upwards, forming a reservoir for slurry on the face of the pad.

Other objects, features and advantages of the present invention will become apparent in light of the following description thereof.

DETAILED DESCRIPTION OF THE INVENTION

Figure 1:
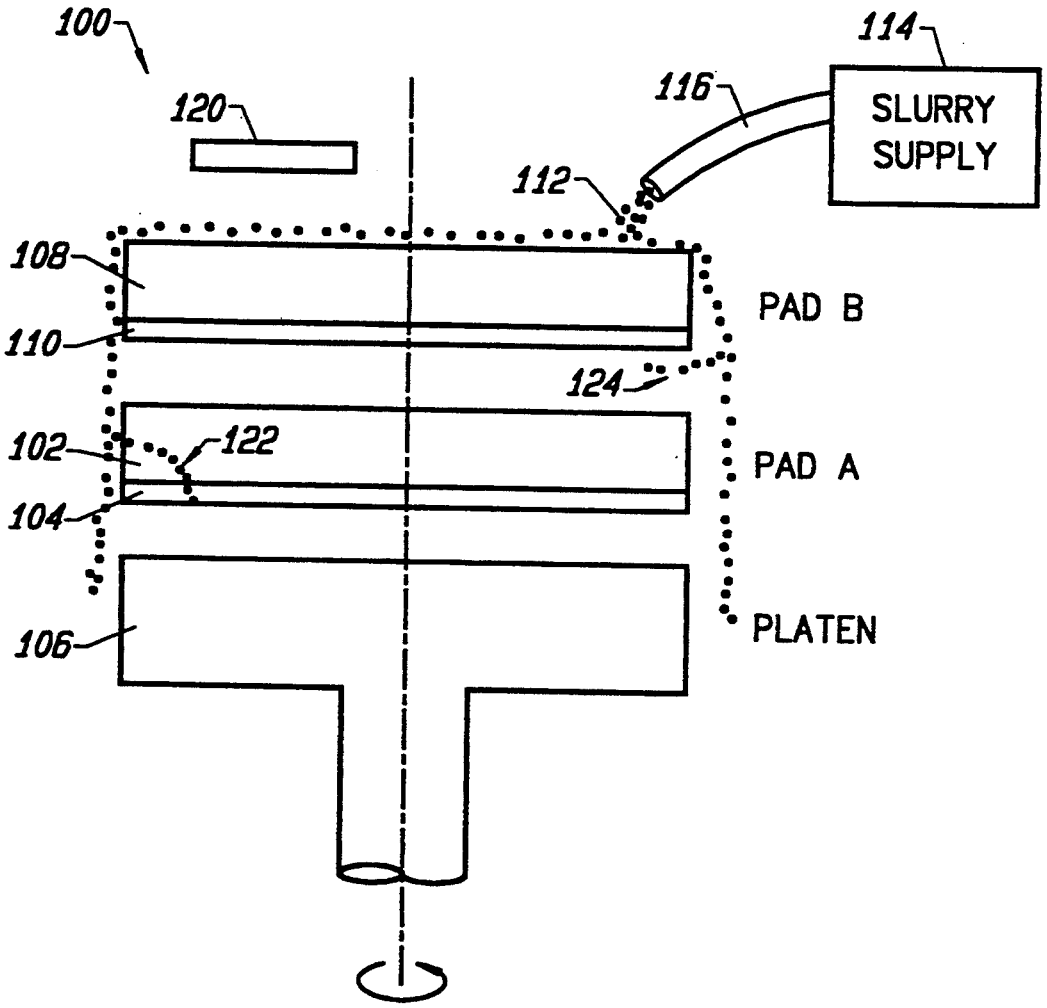
FIG. 1 (PRIOR ART)
FIG. 1 is an exploded, stylized, cross-sectional view of prior art chemi-mechanical polishing apparatus.

FIG. 1 shows chemi-mechanical polishing apparatus 100 of the prior art, and has been discussed above.

As discussed above, two problems are significant: (1) failure to completely consume the slurry before it "washes over" the face of PAD B, and is lost; and (2) catastrophic delamination of PAD B from PAD A.

Figure 2A:
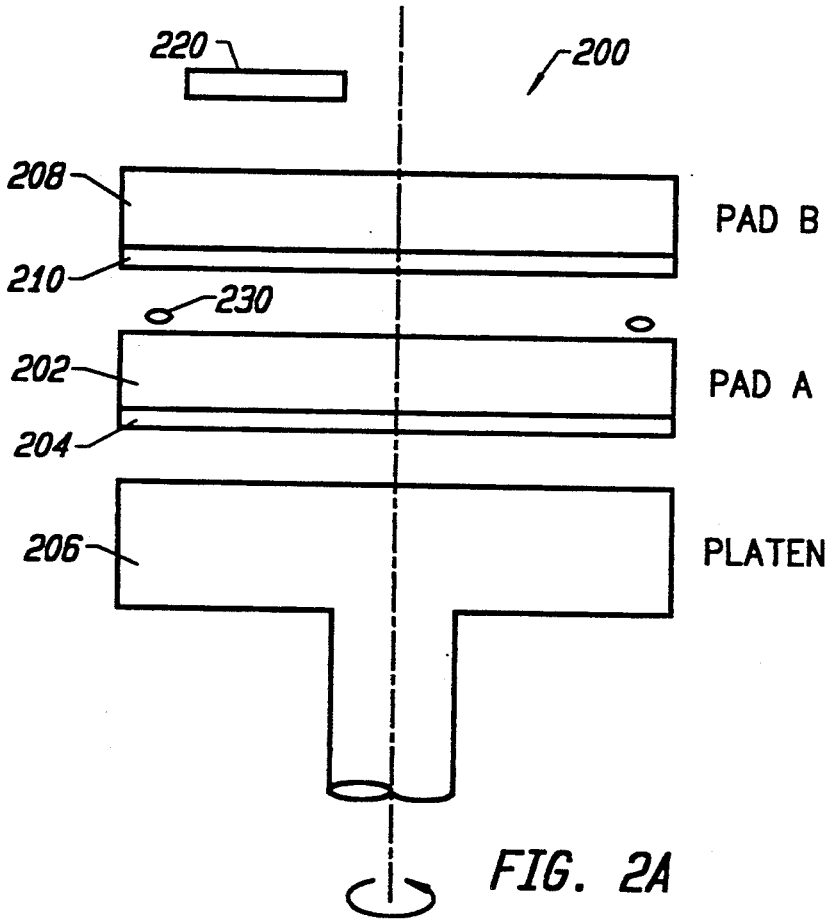
FIG. 2A is an exploded, stylized, cross-sectional view of the polishing apparatus of the present invention.
Figure 2B:
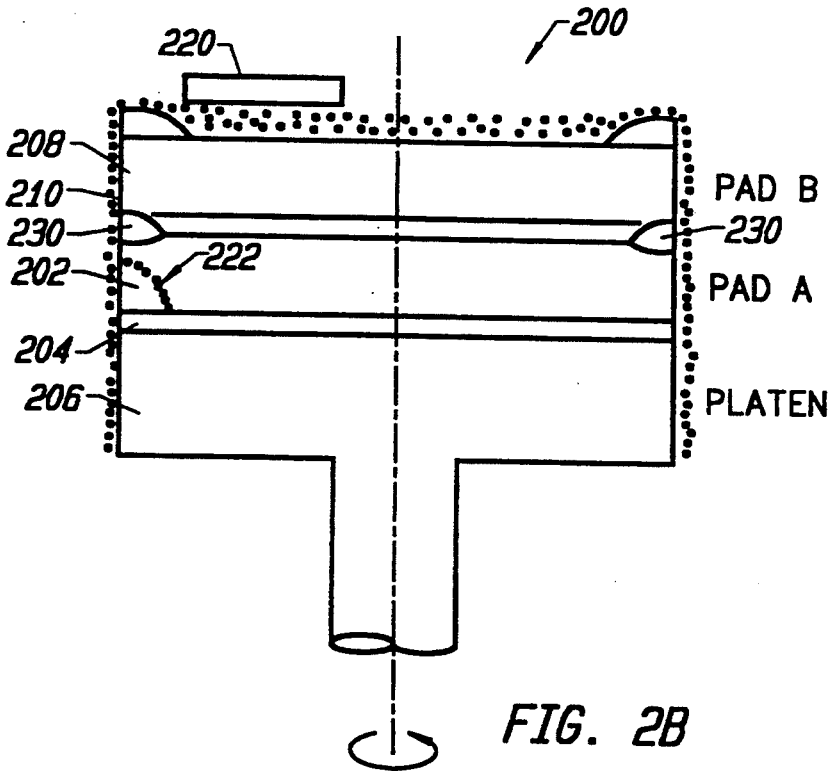
FIG. 2B is cross-sectional view of the assembled polishing apparatus of FIG. 2A.

FIG. 2A shows the polishing apparatus 200 of the present invention prior to assembly. FIG. 2B shows the apparatus 200 after assembly.

In a manner consistent with the prior art, a first disc-shaped pad 202 (PAD A) having a layer of self-sticking adhesive 204 on its back face is adhered (shown exploded) to the front face of a rotating platen 206 (PLATEN). A second disc-shaped pad 208 (PAD B) having a layer of self-sticking adhesive 210 on its back face is adhered (shown exploded) to the front face of the first pad 202.

Typical pad materials are: (1) for PAD A, foamed polyurethane; and (2) for PAD B, polyester felt stiffened with polyurethane resin. The adhesive backings 104 and 110 for the pads are typically polyurethane based. Generally, it is preferable that PAD B is stiffer than PAD A. In the case that PAD A is also doped with polyurethane resin, this can be achieved simply by doping PAD B with more polyurethane than PAD A.

Ultimately, a silicon wafer 220 will be lightly pressed against the front surface of PAD B so that formations (on the wafer) sought to be polished are acted upon by the action of PAD B and the slurry. Typically, the pads 202 and 208 and the platen 206 are on the order of 20–30 inches in diameter, the wafer is 4–6 inches in diameter, and polishing is performed in the center $\frac{2}{3}$ portion of PAD B.

In marked deviation from the prior art, prior to assembling the pads, a bead of silicon-based gasket material 230 is applied about a peripheral portion of the PAD A/PAD B interface to form a seal protecting the adhesive 210 from destructive chemical action by the slurry (i.e., in the catastrophic, edgewise mode). As viewed in FIG. 2B, when assembled, the seal will extend to or nearly to the periphery of the pads. (It would be undesirable to have any of the gasket material squish out from between the pads.)

FIG. 2B shows the assembled composite pad (i.e., pads 202 and 208) mounted to a rotating platen 206. The dimensions are exaggerated to illustrate the concept that the gasket material 230 forms a relatively impervious barrier about the periphery of the pad-to-pad interface, protecting the adhesive 210 from chemical attack by the slurry. Due to the presence of the gasket material 230 between the pads, the front face of the PAD B is pushed up, forming a lip around the periphery of the PAD B. This forms a reservoir which can hold a greater amount of polishing slurry than a planar pad (compare FIG. 1). Polishing slurry is shown in FIG. 2B as two rows of dots, indicating that a reservoir is created which can hold more slurry on the face of PAD B. (FIG. 1, wherein the front face of PAD B was planar, showed a single row of dots.) The ability to hold more slurry on the face of PAD B will result in a longer "residence time" for the slurry to polish a face of a wafer 220.

While polishing slurry will still wash over the periphery of the PAD B 208, it is evident that the edgewise catastrophic failure mode is alleviated by the bead of gasket material. Wicking will still occur, as indicated by the dots 222 (compare 122 of FIG. 1), but this failure mode is much more tolerable.

Evidently, the inner approximately two thirds of the PAD B 208 is still planar, despite the additional material 230 around its perimeter. FIG. 2B shows a wafer 220 being polished in this planar area on the front face of the PAD B 208.

The platen 206 is rotated, and a metered stream of slurry 212 (shown as dots) from a slurry supply 214 is delivered via a slurry feed 216 to the front face of PAD B. Evidently, centrifugal forces and gravity will tend to cause the slurry to flow over the periphery of PAD B (not shown, compare FIG. 1). However, because of the lipped front surface of the PAD B, it is possible to control the residence time of the slurry on the PAD B so that the slurry can be completely or nearly completely depleted prior to overflowing.

Experiments with the technique of the present invention have shown a dramatic reduction in the feed rate of slurry, from about 175 ml/min (milli-liters per minute) without the invention to about 100 ml/min with the invention. In light of the relatively high cost of polishing slurry, it is readily seen that either (1) less slurry can be used, or (2) a more expensive slurry can be used with no net increase in cost.

Moreover, it has been demonstrated that catastrophic delamination of the polishing pads has been significantly delayed, on the order of matching the time required for the wicking failure mode (i.e., about three days).

The bead of silicon-based gasket material is preferably applied a few thousandths of an inch thick (e.g., 0.002–0.003 inch) and with a width (radial extent) of about one tenth inch. When the pads are assembled together, the bead will "squish" to a width of about one half to one inch. (This accounts for why the bead is applied about one inch within the perimeter of the pads.) Preferably, the bead would cure quickly, i.e. on the order of one half hour. Using bead materials that take hours to cure, it is recommended to perform the setup (assembly) of the pads the evening before the polishing apparatus will be used.

It is evident that the dimensions of the bead can be adjusted to meet the specifics of a particular application. For example, if a larger "reservoir" is desired on the front face of PAD B, a thicker bead of gasket material can be applied.

Typical pad materials are: (1) for PAD A, foamed polyurethane; and (2) for PAD B, polyester felt stiffened with polyurethane resin. The adhesive backings 104 and 110 for the pads are typically polyurethane based. Generally, it is preferable that PAD B is stiffer than PAD A. In the case that PAD A is also doped with polyurethane resin, this can be achieved simply by doping PAD B with more polyurethane than PAD A.

The question arises, why not eliminate the polyurethane-based adhesive (210) and simply adhere the pads together with silicon-based adhesive that is relatively more impervious to the slurry? The answer, simply stated, is that pads are readily available with a uniform coating of polyurethane-based adhesive. It would be difficult for the polishing equipment operator to apply such a uniform coating of the silicon-based adhesive. Nevertheless, it is contemplated by this invention that the pads could be assembled with a silicon-based adhesive.

Another question that arises is why there is little concern over catastrophic delamination of PAD A from the platen. The answer, simply stated, is that inasmuch as the platen is a flat smooth surface, a more "intimate" bond is created between a pad and the platen than between two compliant pads. Nevertheless, it is contemplated by this invention that a bead similar to the bead 230 could be interposed between PAD A and the platen. In the case of polishing apparatus employing only one pad mounted to a platen, while delamination may not be an issue, the bead would still result in a bowled front surface for the pad, with advantages as discussed above.

Figure 3:
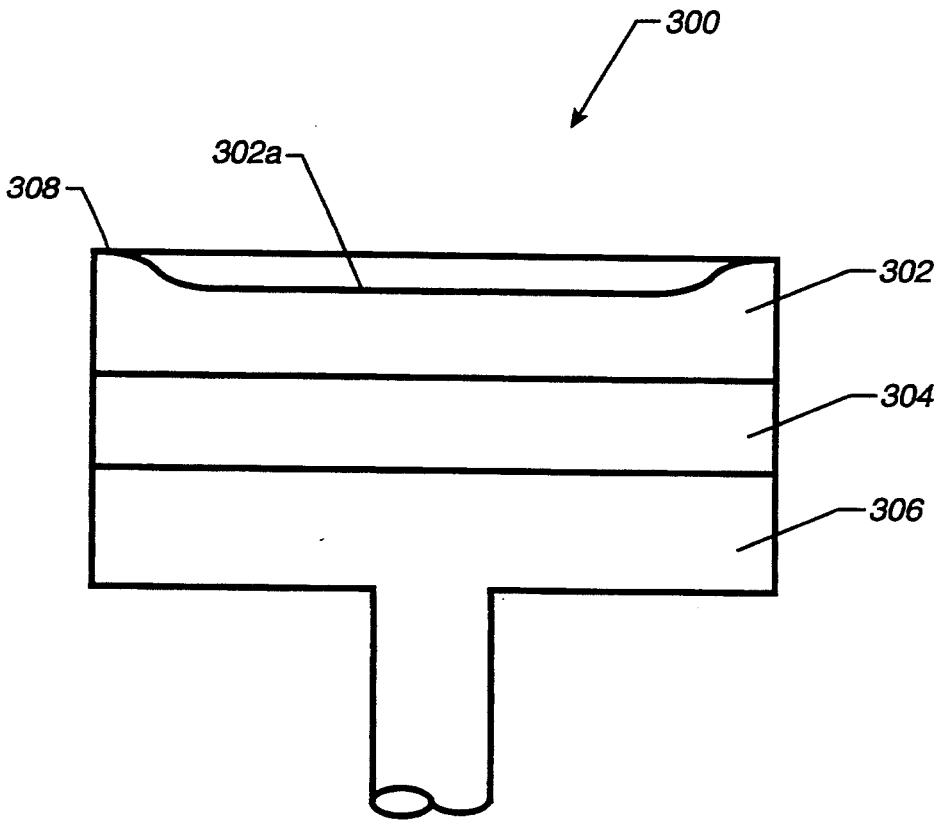
FIG. 3 is a cross-sectional view of another embodiment of the present invention.

FIG. 3 shows an integral composite pad 300 comprising an upper pad 302 bonded to a lower pad 304, atop a rotating platen 306. The upper pad 302 is preferably stiffer than the lower pad. The front face 302*a* of the upper pad 302 is flat, from the center towards an edge region 308. The edge region 308 is formed as an annular lip, extending upwards from the front face of the pad. In this manner, a reservoir of slurry is formed on the front face of the pad, increasing the residence time of the slurry.

What is claimed is:

1. Apparatus for planarizing by chemi-mechanical polishing a generally flat surface of a semiconductor wafer, comprising:

a rotating platen having a front face;

at least one polishing pad, the at least one pad having a center, having a front face, having a central area of the front face which is entirely flat for planarizing a generally flat surface of a semiconductor wafer, and having a back face adhering to the front face of the platen; and a bead of material extending around a peripheral region of the back face of the at least one polishing pad and urging the front face of the at least one polishing pad away from the front face of the platen and causing an annular lip to be formed around a peripheral region of the front face of the at least one polishing pad, the peripheral region of the front face of the at least one polishing pad being non-flat and disposed entirely outside of the central area of the front face of the at least one polishing pad;

the central area of the front face of the at least one polishing pad being entirely within an area defined by the annular lip and being substantially planar for planarizing the surface of a semiconductor wafer.

2. Apparatus according to claim 1, wherein:

the at least one polishing pad includes two polishing pads, a first planar polishing pad adhered to the platen and a second polishing pad adhered by a back face to the first polishing pad, the second polishing pad having a front face for planarizing the surface of the wafer; and the bead extends around a peripheral region of an interface between the two polishing pads and forms a seal around the peripheral region making the interface between the two pads impervious to chemical action from polishing slurry;

the bead urges the front face of the second polishing pad upward and forms the annular lip around a peripheral region of the front face of the second polishing pad; and a central area of the front face of the second polishing pad, entirely within the peripheral region, remains planar for planarizing the surface of the semiconductor wafer.

3. Apparatus according to claim 2, wherein:

the second polishing pad is stiffer than the first polishing pad.

4. Apparatus according to claim 2, wherein: the bead is a silicon-based gasket material.

5. Apparatus according to claim 4, wherein: the gasket material is a silicon caulk.

6. Apparatus according to claim 4, wherein: the gasket material is a silicon adhesive.

7. Apparatus according to claim 1, wherein:

the annular lip around the peripheral region of the front face of the at least one polishing pad allows chemical-mechanical polishing slurry to accumulate in the central area of the front face of the at least one polishing pad during chemical-mechanical polishing of the wafer.

8. Apparatus according to claim 7, wherein:

the at least one polishing pad has a diameter of about 20–30 inches;

the bead has a radial width of one half to one inch and a thickness of about two to three thousandths of an inch;

the annular lip extends higher from the platen than the central area of the front face of the at least one polishing pad; and the peripheral region of the front face of the at least one polishing pad extends from a peripheral edge of the at least one polishing pad, inward one inch towards the center of the at least one polishing pad.

9. Apparatus for chemi-mechanical polishing of semiconductor wafers, according to claim 1, wherein:

the flat central area of the front face of the at least one polishing pad comprises at least two thirds of a total surface area of the front face of the at least one polishing pad.

10. Apparatus for chemi-mechanical polishing of semiconductor wafers, according to claim 1, wherein:

the bead causes the peripheral region of the at least one polishing pad to push up and form the annular lip about the peripheral region of the at least one polishing pad while allowing an inner approximately two thirds area of the at least one polishing pad to remain planar.

11. Chemical-mechanical polishing apparatus, comprising:

a polishing pad disposed on a rotating platen, a relatively substantial central area of the polishing pad being planar for planarizing a surface of a semiconductor wafer, a relatively insubstantial peripheral area outside of the central area including an annular lip extending above a plane of the central area for retaining chemical-mechanical polishing slurry on the central area;

an additional pad which is flat over its entire area disposed between the polishing pad and the platen; and a bead of gasket material disposed around a peripheral interface of the polishing pad and the additional pad, causing the annular lip to extend above the plane of the central area.

12. Apparatus for chemical-mechanically polishing a semiconductor wafer, comprising:

a round, rotating platen;

a first, planar polishing pad adhered to the platen;

a second polishing pad adhered to the first polishing pad;

a lip formed in a peripheral region of the second polishing pad for retaining polishing slurry on the second polishing pad;

a central region of the second polishing pad being perfectly flat for chemical-mechanically polishing a semiconductor wafer wherein the lip is formed by a bead of material disposed between the first polishing pad and the second polishing pad.

13. Chemical-mechanical polishing apparatus, comprising:

a polishing pad disposed on a rotating platen, a relatively substantial central area of the polishing pad being planar for planarizing a surface of a semiconductor wafer, a relatively insubstantial peripheral area outside of the central area including an annular lip extending above a plane of the central area for retaining chemical-mechanical polishing slurry on the central area;

an additional pad which is flat over its entire area disposed between the polishing pad and the platen; and a bead of gasket material disposed around a peripheral interface of the polishing pad and the additional pad, causing the annular lip to extend above the plane of the central area.

14. Chemical-mechanical polishing apparatus, according to claim 13, wherein:

the central area extends from a center of the pad to two-thirds of a radial distance to a peripheral edge of the pad.

15. Chemical-mechanical polishing apparatus, according to claim 13, wherein:

the annular lip extends a few thousandths of an inch above the plane of the central area.

16. Apparatus for chemical-mechanically polishing a semiconductor wafer, comprising:

a round, rotating platen;

a first, planar polishing pad adhered to the platen;

a second polishing pad adhered to the first polishing pad;

an annular non-planar structure formed in a peripheral region of the second polishing pad for retaining polishing slurry on the second polishing pad;

a central region of the second polishing pad being perfectly flat for chemical-mechanically polishing a semiconductor wafer;

wherein the annular, non-planar structure is a lip formed by a bead of material disposed between the first polishing pad and the second polishing pad.

* * * * *